US012098614B2

(12) United States Patent
Horn et al.

(10) Patent No.: US 12,098,614 B2
(45) Date of Patent: Sep. 24, 2024

(54) DOWNHOLE APPARATUS AND METHODS FOR CASING

(71) Applicant: DELTATEK OIL TOOLS LIMITED, Dyce (GB)

(72) Inventors: Tristam Paul Horn, Kingswells (GB); Stephen Edmund Bruce, Carsie (GB); David Michael Shand, North Mains of Drum (GB)

(73) Assignee: Deltatek Oil Tools Limited, Dyce (GB)

( * ) Notice: Subject to any disclaimer, the term of this patent is extended or adjusted under 35 U.S.C. 154(b) by 203 days.

(21) Appl. No.: 17/631,184

(22) PCT Filed: Aug. 13, 2020

(86) PCT No.: PCT/GB2020/051933

§ 371 (c)(1),
(2) Date: Jan. 28, 2022

(87) PCT Pub. No.: WO2021/028689

PCT Pub. Date: Feb. 18, 2021

(65) Prior Publication Data

US 2022/0268127 A1 Aug. 25, 2022

(30) Foreign Application Priority Data

Aug. 14, 2019 (GB) ..... 1911653

(51) Int. Cl.
*E21B 17/14* (2006.01)
*E21B 33/14* (2006.01)

(52) U.S. Cl.
CPC ..... *E21B 33/143* (2013.01); *E21B 17/14* (2013.01)

(58) Field of Classification Search
CPC ..... E21B 17/14; E21B 33/143
See application file for complete search history.

(56) References Cited

U.S. PATENT DOCUMENTS 4,191,250 A * 3/1980 Messenger ..... E21B 47/001 166/253.1
6,386,291 B1 * 5/2002 Short ..... E21B 34/04 166/88.1

(Continued)

FOREIGN PATENT DOCUMENTS

GB 2 361 724 10/2001
GB 2 565 098 2/2019

(Continued)

*Primary Examiner* — Matthew R Buck
(74) *Attorney, Agent, or Firm* — Dorton & Willis LLP; Ryan Willis

(57) ABSTRACT

A well construction method, and corresponding apparatus, in which a drilled bore (106) is lined with a plurality of successively smaller diameter sections of bore-lining tubing includes at least one casing (108, 110, 112) and at least one liner (120). The well construction method comprises: drilling a final section of a bore (106) to intersect a hydrocarbon-bearing formation (130); providing a shoe (134) at a distal end of a liner and a running tool (150) at a proximal end of the liner, and coupling an inner string (140) between the shoe (134) and the running tool (150); running the liner (120) into the final section of the bore (106) such that the liner extends into the hydrocarbon-bearing formation (130); pumping a settable material (116) from surface (104), through the inner string (140), and through the shoe (134) to at least partially fill an outer annulus (114) surrounding the liner (120); and retrieving the inner string (140) and the running tool (150).

19 Claims, 3 Drawing Sheets

(56) References Cited

U.S. PATENT DOCUMENTS

| | | | | |
|---|---|---|---|---|
| 6,968,618 | B2 * | 11/2005 | Cook | E21B 17/042 285/333 |
| 7,275,605 | B2 * | 10/2007 | Smith | E21B 17/14 175/57 |
| 2009/0090508 | A1 * | 4/2009 | Brouse | E21B 33/14 175/171 |

FOREIGN PATENT DOCUMENTS

| | | |
|---|---|---|
| GB | 1911653.2 | 11/2019 |
| RU | 2 657 584 | 6/2018 |
| WO | 2021/028689 | 2/2021 |

* cited by examiner

DOWNHOLE APPARATUS AND METHODS FOR CASING

This application is a national stage of PCT/GB2020/051933, filed Aug. 13, 2020, which claimed priority to Great Britain patent application number 1911653.2, filed Aug. 14, 2019, all of which are incorporated by reference.

FIELD

This disclosure relates to downhole apparatus and methods, and to well construction apparatus and methods.

BACKGROUND

In the oil and gas exploration and production industry wells are constructed to provide access to subsurface hydrocarbon-bearing rock formations, with a bore being drilled from surface to intersect the hydrocarbon-bearing formation. After drilling a section of bore, metal tubing is placed in the bore and an annulus between the tubing and the wall of the drilled bore is sealed with cement. Successive bore sections are lined with smaller diameter metal tubing. The metal tubing may extend back to surface, such tubing being known as casing, or may only extend part way up the bore, such tubing being referred to as liner. A work or running string is used to support a section of liner as the liner is run into the bore, and the arrangement of supports, slips (gripping elements) and seals which secure and seal the upper end of a liner to the adjacent tubing is typically referred to as a liner hanger.

When a section of casing or liner is being cemented in the bore the cement is pumped from surface down through the interior of the casing, or through the running string and the liner. Typically, the cement will completely fill the annulus surrounding a liner placed at the bottom or distal end of a bore and which intersects the hydrocarbon-bearing formation. Further, it is standard practice to prepare and pump a volume of cement slurry (cement, water and chemical additives) in excess of the volume of the liner annulus to be filled to ensure the cemented volume matches or exceeds the annular volume to account for any drilled diameter excess and to ensure that the cement extends over and around the seals in the liner hanger. For intermediate liners and casing only a lower or distal section of the annulus may be filled with cement, sufficient to ensure a hydraulic seal and to prevent hydrocarbon leakage from lower formations.

In conventional well casing or liner cementing operations a float shoe is provided at or adjacent the leading or distal end of the tubing, and a float collar is provided perhaps 80 to 160 feet (24.4 to 48.8 m) above the float shoe and provides a landing for cement wiper plugs; to avoid contamination by well or drilling fluid cement is pumped into the bore between the bottom and top wiper plugs. The plugs provide a sliding sealing contact with the inner surface of the tubing and isolate the cement from the drilling fluid that otherwise fills the tubing. When the bottom plug lands on the float collar, continued application of hydraulic pressure from surface ruptures the bottom plug and forces the cement through the plug and the collar, into the volume between the float collar and the float shoe, and then through the float shoe and into the annulus. The cement continues to flow into and fill the annulus until the top plug lands on the bottom plug. The landing of the top plug on the bottom plug is detectable at surface, and at this point the pumping is stopped. This leaves a column of drilling fluid sitting above the top plug and a volume of cement within the distal end of the casing or liner, between the float collar and the float shoe; this volume is known as the shoe track. Typically, this volume of cement is 80 to 160 feet (24.4 to 48.8 m) long.

The provision of the shoe track minimises the risk of well fluid contamination of the cement which fills the annulus surrounding the bottom of the casing or liner, for example by leakage of well fluid past the top wiper plug. However, when the cement cures the operator is left with a solid plug of cement inside the shoe track.

In most instances the operator will choose to drill the cement out the shoe track. This requires provision of a drill bit which is only slightly smaller than the internal diameter of the casing or liner, to ensure removal of all the cement from within the tubing. If the operator is intending to extend the bore further, the drill bit used to remove the cement from the shoe track will then be retrieved to surface and replaced with a slightly smaller drill bit. If the bore is not to be extended further the operator will likely still choose to remove the cement from the shoe track such that the distal end portion of the liner may be utilised to, for example, provide access to a surrounding hydrocarbon-bearing formation.

Methods and apparatus for use in running bore-lining tubing are described in applicant's earlier patent applications, including GB2565180A, GB2565098A, WO2019025798, WO2019025799, WO2017103601, EP3507447, GB2525148A and GB2545495A, the disclosures of which are incorporated herein in their entirety.

SUMMARY

According to a first aspect of the present disclosure there is provided a well construction method in which a drilled bore is lined with a plurality of successively smaller diameter sections of bore-lining tubing including at least one casing and at least one liner, the well construction method comprising:

- drilling a final section of a bore to intersect a hydrocarbon-bearing formation;
- providing a shoe at a distal end of a liner, a running tool at a proximal end of the liner, and an inner string extending between the shoe and the running tool;
- running the liner into the final section of the bore such that the liner extends into the hydrocarbon-bearing formation;
- pumping a settable material from surface, through the inner string, and through the shoe to at least partially fill an outer annulus surrounding the liner; and
- retrieving the inner string and the running tool.

The disclosure also relates to apparatus for implementing at least part of the method and to a well that has been constructed in accordance with the method.

This aspect of the disclosure may have utility where an operator has identified that a hydrocarbon-bearing formation is located above and in close proximity to a potentially problematic formation, for example porous formations containing high-pressure fluid or, a low-pressure formation. The use of the inner string to supply the settable fluid to the shoe avoids creation of a cement-filled shoe track which the operator would otherwise likely choose to drill out, running a risk that the shoe track drilling operation would affect the integrity of the cement surrounding the distal end of the liner or breach the problematic formation. Drilling out cement in the shoe track is also very time-consuming, particularly in a sub-sea or deep-water location.

The liner, or at least a portion of the liner extending into or through the hydrocarbon-bearing formation, may then be reconfigured to permit fluid to flow from the hydrocarbon-bearing formation into the liner. For example, the liner may be perforated.

The liner may be run into the bore on a running or work string, which work string may be in fluid communication with the inner string.

The bore may be drilled in the seabed. A riser may extend from a mobile offshore drilling unit such as a semi-submersible drilling rig, drill ship or the like to the seabed and the liner may be run into the bore through the riser.

The method may further comprise:

filling an inner annulus between the liner and the inner string with fluid; and allowing fluid to flow between the bore and the inner annulus as the liner is run into the bore to equalise pressure therebetween.

The fluid may be permitted to flow between the bore and the inner annulus via the inner string and a port in the inner string.

The method may further comprise providing a hanger on the liner and activating the hanger to seal and secure the liner to a surrounding bore-lining tubing, such as a previously set casing or liner. The hanger may include an arrangement for securing or fixing the liner to the surrounding bore-lining tubing, for example one or more slips or other gripping arrangements. The previously set casing or liner may include an arrangement for cooperating with the liner hanger. The liner hanger may include an arrangement for sealing an annulus between the liner and the surrounding bore-lining casing, such as one or more packers.

The inner string may feature an arrangement like that described in GB2525148A and GB2545495A. The arrangement may permit the distal or leading end of the inner string to be coupled to the shoe, and the inner string then be telescopically retracted or compressed to allow a running tool coupled to the proximal or upper end of the inner string to be engaged, via a threaded connection, with the proximal or upper end of the liner, without transfer of torque to the distal end of the inner string. When the inner string and the running tool are to be retrieved, the running tool may be disengaged from the liner, and the string then extended to allow transfer of torque to the distal end of the inner string to disengage a threaded connection between the string and the shoe.

According to a second aspect of the present disclosure there is provided a well construction method in which a drilled bore is lined with a plurality of successively smaller diameter sections of bore-lining tubing, the well construction method comprising:

providing a shoe at a distal end of a bore-lining tubing, a running tool at a proximal end of the bore-lining tubing, and an inner string extending between the shoe and the running tool;

running the bore-lining tubing into a drilled bore;

pumping a settable material from surface, through the inner string, and through the shoe to at least partially fill an outer annulus surrounding the bore-lining tubing;

retrieving the inner string and the running tool;

running a pilot drill bit of a first cutting diameter into the bore and through the bore-lining tubing;

drilling beyond the distal end of the bore-lining tubing with the pilot drill bit to form a pilot bore;

retrieving the pilot drill bit;

running a larger drill bit of a second cutting diameter larger than the first cutting diameter into the bore; and enlarging the pilot bore with the larger drill bit.

The disclosure also relates to apparatus for implementing at least part of the method.

The drilling of the pilot bore may provide several advantages. For example, the pilot bore allows geophysical data to be obtained for the formations beyond the end of the bore-lining tubing. The operator will then be better informed before drilling the larger diameter bore and the geophysical data may permit the larger diameter bore to be drilled more safely, and more efficiently. The operator will have been alerted to, for example, rock type, formation pressures, porosities and hardness, allowing selection of the most appropriate drilling fluids, drilling fluid pressures, and drill bit form. The use of the inner string coupled to the tubing distal end to deliver the settable material eliminates the creation of a cement-filled shoe track at the distal end of the bore-lining tubing above the shoe. If a cement-filled shoe track was present an operator would likely choose to drill out the shoe track before drilling the pilot bore. Drilling out the shoe track would require use of a drill bit having a drilling diameter only slightly smaller than the internal diameter of the bore-lining tubing, to ensure removal of substantially all the cement. This drill bit would then have to be retrieved and replaced with the pilot drill bit before drilling of the smaller pilot bore could commence. With the method of the present disclosure, if the operator chooses to leave a volume of cement above the shoe, this cement is contained within the distal or bottom end of the inner string. The inner string may include an arrangement like that described in GB2565180A or GB2565098A, in which any cement remaining in the distal end of the inner string may be circulated out following closing of the flow port in the shoe. Further, the temperature of the fluid that is circulated through the inner string and the inner annulus may be controlled to influence or control the curing of the cement in the annulus, as described in GB2565180A. Alternatively, or in addition, a volume of cement may be retained in the inner string and may be retrieved to surface for analysis and testing.

The method may further comprise drilling through the shoe with the pilot drill bit.

The method may further comprise:

filling an inner annulus between the bore-lining tubing and the inner string with fluid; and allowing fluid to flow between the bore and the inner annulus as the bore-lining tubing is run into the bore to equalise pressure therebetween.

The fluid may be permitted to flow between the bore and the inner annulus via the inner string and a port in the inner string.

Alternatively, or in addition, the method may further comprise hydraulically pressure-testing the bore-lining tubing prior to running the tubing to final depth. This may be achieved by temporarily isolating the inner annulus, pressurising the fluid in the inner annulus, and then monitoring for any loss of pressure. If an unacceptable loss of pressure is apparent, the source of the pressure leak may be identified and remedied before the bore-lining tubing is run further into the bore.

According to a third aspect of the present disclosure there is provided a well construction method in which a drilled bore is lined with a plurality of successively smaller diameter sections of bore-lining tubing, the well construction method comprising:

providing a shoe at a distal end of a bore-lining tubing, a running tool at a proximal end of the tubing, and an inner string between the shoe and the running tool;

running the bore-lining tubing into a drilled bore;

displacing fluid from a volume of the bore below the shoe up through the inner string;

pumping a settable material from surface, through the inner string, and through the shoe to at least partially fill an outer annulus surrounding the bore-lining tubing; and retrieving the inner string and the running tool.

The bore-lining tubing sections in the bore may include at least one casing and at least one liner. It is envisaged that this aspect of the disclosure will have utility in the running and setting of liner, but the method may also be utilised in the running and setting of casing.

The disclosure also relates to apparatus for implementing at least part of the method.

This aspect may have utility in constructing a well featuring close-tolerance tubing, that is tubing that only features small differences in diameter between adjacent bore-lining tubing sections. By providing a flow path through the inner string, and optionally through an inner annulus between the inner string and the bore-lining tubing, it may be possible to run the tubing into the well more quickly while avoiding pressure surging which may, for example, damage the formation surrounding the open hole by forcing well fluid into the formation.

As the settable material utilised to fill the annulus is delivered through the inner string, little or no settable material remains within the bore-lining tubing, that is there is no cement-filled shoe track which must be drilled out following cementing of the tubing. Accordingly, the distal end of the tubing may be immediately available to the operator, without the requirement to drill out or otherwise remove a column of set cement.

The displaced fluid may pass through a flow port in the shoe and into the inner string. The flow port may be provided with a float or check valve that is initially held open, or otherwise inactivated, to allow fluid to flow from the volume of the bore below the shoe and into the inner string. Once activated, the check valve prevents flow from the volume below the shoe into the inner string but permits flow from the inner string into the volume. The fluid may pass between the inner string and an inner annulus between the inner string and the tubing. In one example the fluid may pass from a distal end of the inner string into a distal end of the inner annulus, and from a proximal end of the inner annulus into a proximal end of the inner string. The displaced fluid may pass from the inner string into a portion or volume of the bore above the running tool. Additionally, displaced fluid will also flow up between the outside diameter of the bore-lining tubing and the inside diameter of the surrounding bore wall or casing.

Valves or other flow control arrangements may be provided to control the flow of displaced fluid from and into the inner string.

The method may further comprise:

filling an inner annulus between the liner and the inner string with fluid; and running the liner into a fluid-filled drilled bore and allowing fluid to flow between the bore and the inner annulus to equalise pressure therebetween.

The fluid may be permitted to flow between the bore and the inner annulus via the inner string and a port in the inner string.

The inner string may be coupled to a running or work string. The work string may support the liner as the liner is run into the bore. Fluid displaced from the bore volume below the shoe may pass from the inner string, into the work string, and then from the work string into a volume surrounding the work string.

The method may further comprise providing a hanger on the liner and activating the hanger to seal and secure the liner to a surrounding bore-lining tubing, such as a previously set casing or liner. The hanger may include an arrangement for securing or fixing the liner to the surrounding bore-lining tubing, for example one or more slips or other gripping arrangements. The hanger may include an arrangement for sealing an annulus between the liner and the surrounding bore-lining casing, such as one or more packers.

The various features described above may have individual utility. Further, the various features described above with reference to one of the aspects, and as recited in the dependent claims below, may also be provided in combination with one or more of the other aspects.

The various aspects of the disclosure may have individual utility, and one aspect may be combined with one or more of the other aspects.

The steps of the various methods may be carried out sequentially in the order as described. However, some steps may be carried out simultaneously, or may at least partially overlap. Alternatively, the steps may be carried out in a different sequence.

BRIEF DESCRIPTION OF THE DRAWINGS

These and other aspects of the disclosure will now be described, by way of example, with reference to the drawings, in which.

DETAILED DESCRIPTION OF THE DRAWINGS

Figure 1:
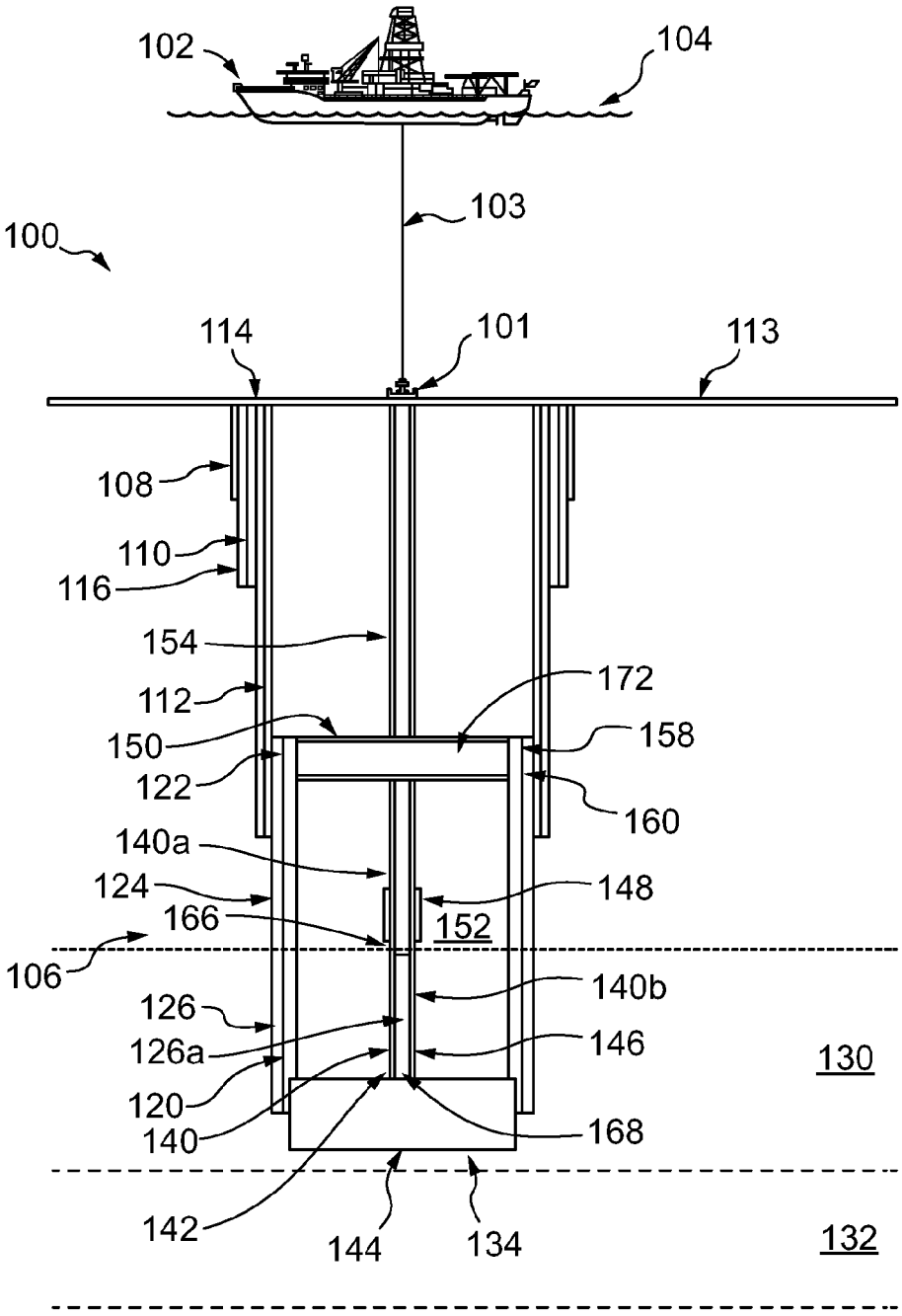
FIG. 1 is a schematic of a deep-water oil and gas well illustrating a well construction method and apparatus in accordance with a first aspect of the present disclosure.

Referring first to FIG. 1 of the drawings, a deep-water oil and gas well 100 is illustrated. Well construction operations are conducted primarily from a mobile offshore drilling unit 102 on the sea surface 104. A riser 103 extends from the drilling unit 102 to a wellhead 101 on the seabed 113. Work strings, tools and other apparatus may pass between the drilling unit 102 and the wellhead 101 via the riser 103. The well 100 includes a bore 106 which has been drilled in sections and lined with successively smaller bore-lining tubing sections 108, 110, 112, 120.

The illustrated well 100 includes three casing sections 108, 110 and 112 which extend back to the seabed 113 and serve to support the surrounding bore wall, which may include weak zones which would otherwise be liable to collapse. The casings 108, 110, 112 also isolate any water, gas or oil-bearing zones and provide support for the next casing. An annulus 114 surrounds each casing 108, 110, 112 and is at least partially filled with settable material, typically a cement 116.

The illustrated well also includes a liner 120 which extends to the end of the bore 106. The liner 120 may have a generally similar form to the casings 108, 110, 112 but does not extend back to the seabed 113. In this example the liner 120 is sealed and secured to a distal portion of the innermost casing 112 with a liner hanger 122. An outer annulus 124 between the liner 120 and the surrounding bore wall is sealed with cement 126.

In the illustrated example the bore 106 extends into a hydrocarbon-bearing formation 130. Surveys may have indicated to the operator that a formation 132 below the hydrocarbon-bearing formation 130 is potentially problematic, for example the formation 132 may contain fluid at high pressure such that extending the bore 106 and breaching the formation 132 may result in high pressure fluid flooding into the well 100 and creating difficulties for the operator.

In the illustrated well 100 the first casing 108, sometimes referred to as a conductor, is a 36" (91.4 cm) casing 108, that is a casing having an external diameter of 36 inches (91.4 cm). The casing 108 may have been placed by jetting, that is by providing a shoe on the lower or distal end of the casing 108 and pumping water through jetting nozzles in the shoe to displace sediment and allow the casing 108 to be lowered into the seabed. In other situations, the casing may have been run into a drilled bore and then sealed and secured in the bore within a cement sheath.

A 28" (71.1 cm) casing 110 is next located in the bore 106, followed by a 22" (55.9 cm) casing 112. A 22" (55.9 cm) bore is drilled and under reamed beyond the end of the casing 110. An 18" (45.7 cm) liner 120 is then run into and cemented in the bore 106, as described in detail below.

The liner 120 is made up from liner sections on the deck of the drilling unit 102. The leading or distal end of the liner 120 is provided with a liner shoe 134. The shoe 134 is a float shoe and allows an end adaptor 142 on the end of an inner string 140 to form a sealing engagement with the shoe 134, as will be described. The inner string 140 will typically be of significantly smaller diameter than the liner 120, and in this example the inner string 140 may have an outer diameter of 5", 5½" or 5⅞" (12.7, 14.0, 14.9 cm). In other examples the inner string 140 may have any appropriate diameter, such as between 2⅞" and 5⅞" (7.3 and 14.9 cm).

Once the liner 120 has been made up and is suspended from the slips on the deck of the drilling unit 102, the inner string 140 is made up and run into the liner 120. The inner string 140 includes an end connector 142 which may be latched into a flow passage 144 in the liner shoe 134. The flow passage 144 features a float or check valve which prevents flow of fluid from below the shoe 134 and into the inner string 140 while permitting flow from the inner string 140 through the flow passage 144 and out of the shoe 134. The end connector 142 may be disengaged from the shoe 134 by rotating the connector 142 relative to the shoe 134.

The lower or distal end of the inner string 140 includes a valved port 146 including a burst disc or the like. The valve in the port 146 is initially closed. In other examples the port 146 may be provided without a valve, the port remaining open.

The inner string 140 also includes a telescopic section 148. When the telescopic section 148 is extended, complementary splined portions engage and permit the transfer of torque through the section 148. However, when the section 148 is retracted or compressed an upper portion of the string **140*a* is rotatable relative to a lower portion 140*b*. The telescopic section 148** may include features such as described in GB2525148A and GB2545495A, the disclosures of which are incorporated herein in their entirety.

Once the inner string 140 has been made up to the appropriate length within the liner 120 the end connector 142 may engage and connect with the shoe 134. Pulling back on the string 140 will confirm that the connector 142 and shoe 134 are properly engaged.

The upper or proximal end of the inner string 140 is then coupled to a liner running tool 150 which includes external left-handed threads configured to cooperate with matching internal threads on the upper or proximal end of the liner 120. In other examples an alternative or supplementary coupling arrangement may be employed between the running tool 150 and the 120, for example cam-actuated load shoulders.

The inner string 140 is then lowered to compress the telescopic section 148 such that the splined portions disengage. The upper portion **140*a* may now be rotated to engage the running tool 150 with the upper end of the liner 120, without transfer of the rotation to the liner lower portion 140*b***.

An inner annulus 152 between the liner 120 and the inner string 140 may be top filled with drilling fluid before engaging the running tool 150 with the liner 120. Also, the inner string 140 may be top filled, as may a liner running string 154 which is subsequently connected to the liner assembly. The top filling may be achieved simply by locating a hose outlet in the upper end of the annulus 152 or string 140, 154 and pumping drilling fluid into the annulus 152 or string 140, 154, or by use of apparatus such as the Top Jet (trade mark) tool supplied by Churchill Drilling Tools.

Once the running tool 154 has been coupled and sealed to the upper end of the liner 120, the liner 120 may be hydraulically pressure tested, for example by pumping fluid into the inner annulus via a port 172 in the running tool 154. If the port 146 in the inner string 140 is open, this will require the bore of the inner string 140 to be temporarily isolated. Once the pressure test of the liner 120 is completed, the inner string bore is re-opened, such that, if the port 146 is open, fluid may flow between the open inner string 140 and the inner annulus 152 to equalise pressure as the liner assembly is run into the bore.

As the liner-running assembly is made up and advanced into the fluid-filled riser 103 and the fluid-filled bore 106, a volume of fluid will be displaced from the riser 103 and the bore 106. The displaced fluid flows upwards through the riser 103 and is collected in an area below the drill-floor of the drilling unit 102. The collected fluid is cleaned and directed to storage, ready for re-use.

The liner assembly is lowered into the well supported by the liner running string 154 until the liner 120 reaches target depth. The liner hanger 122 provided at the upper end of the liner 120 may be activated and slips 158 in the hanger 122 engage the surrounding casing 112. The hanger 122 also includes seals 160 which are initially inactive.

Cement slurry **126*a* is prepared on the mobile offshore drilling unit 102 and is then pumped down through the liner running string 154, the liner running tool 150, the inner string 140, and through the flow port 144 in the shoe 134. Reverse flow of the relatively dense cement slurry 126*a* from the annulus 124 back into the inner string 140 is prevented by the check valve provided in the port 144**.

The operator will have estimated the volume of cement slurry **126*a* required to fill the annulus 124 and will typically prepare an excess of cement, for example 115% of this theoretical annular volume, that is a 15% excess, to accommodate, for example, washed-out or collapsed (and therefore larger volume) portions of annulus 124, or losses of cement slurry 126*a* into porous formations. The cement 126*a* will fill the annulus to at least the level of the liner hanger 122 and will flow over and past the liner hanger seals 160**.

During the cementing operation the rig personnel will monitor the volume of cement 126*a* being pumped into the well and the volume of drilling fluid being returned or displaced from the well.

The volume of cement 126*a* may be separated from the following displacement fluid 164 by a top plug and or ball 166. The cement 126*a* is thus pumped through the liner running string 154, the liner running tool 150, the inner string 140, and the flow port 144 in the shoe 134, until the ball 166 lands in and blocks the flow port 144. The ball 166 is locked in the port 144 and acts in combination with the flow port check valve 144 to prevent any possibility of U-tubing, that is the dense cement slurry 126*a* flowing out of the annulus 124, back through the port 144, and into the inner string 140.

Once pumping of the cement 126*a* into the annulus 124 has been completed the operator continues to apply pressure to activate the liner hanger seals 160 to provide a fluid-tight seal between the upper end of the liner 120 and the surrounding casing 112. In particular, a valved port 146 provided with a shear or burst disc is provided in the lower end of the inner string 140, and by continuing to pump, and increasing the pressure within the string 140, the liner hanger 122 and slips 158 and seals 160 are set. A further increase in pressure opens the initially closed valved port 146. The liner running tool 150 also includes an initially closed valved port 172 which controls flow from the inner annulus 152 into the bore volume above the running tool 150. If the valve 172 is closed, fluid may be pumped into the inner annulus 152 through the lower valve 146 to conduct a pressure test of the liner 120. However, with the valve 172 open, fluid may be reverse circulated through the inner annulus 152 and any residual cement 126*a* in the string 140 is flushed out of the well; fluid may be pumped into the inner annulus 152 from the bore volume above the running tool, and then through the port 146 and up through the inner string 140 to surface.

As noted above, in other examples the port 146 at the lower end of the inner string 140 may be initially open, and this facilitates pressure equalisation of the inner annulus 152 as the liner assembly is run into the bore. When cement is being pumped, the open port will result in the pressure in the annulus 152 increasing, however cement will not tend to flow into the annulus 152 through the open port 146. Further, in alternative examples the port 146 may feature a different valve arrangement. For example, the port 146 may include a valve which opens in response to a predetermined sequence of pressure pulses or a predetermined flow sequence, such as on/off/on/off. In another example the port 146 may include a valve which operates in response to surface deployed communication, such as RFID tags which may be pumped into the inner string 140 when it is desired to change the configuration of the valve to open or close the port 146.

When the operator is ready to retrieve the liner running assembly, the liner running string 154 is rotated to disengage the liner running tool 150 from the upper end of the liner 120. The liner running string 154 is then raised to extend the telescopic section 148 in the inner string 140, allowing torque to be transferred between the inner string portions 140*a*, 140*b*, to disengage the bottom end of the inner string 140 from the liner shoe 134.

Once the cement 126 has set, any further operations, for example perforating the liner 120, may be carried out immediately. There is no requirement to drill out a plug of cement, or the associated plugs and float collar, from the distal end of the liner 120, as would be the case with a conventional liner cementing operation. This provides for a considerable saving in time, reduces the equipment required to be provided on the drilling unit 102, avoids the potential for damage to the liner 120 and the cement 126 from the drilling operation, and removes the risk associated with the cement removal bit advancing too far and breaching the problem formation 132.

Figure 2:
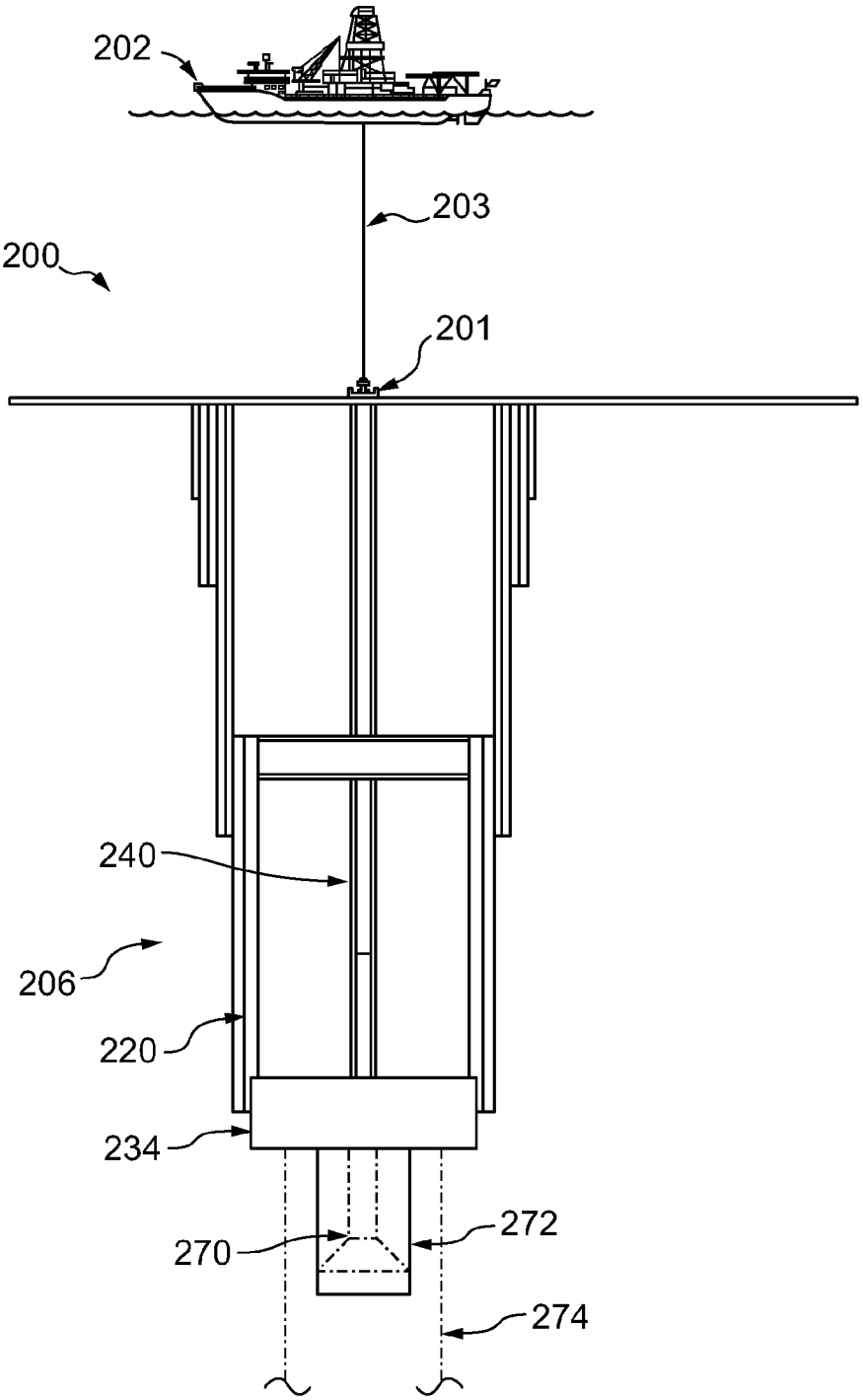
FIG. 2 is a schematic of a deep-water oil and gas well illustrating a well construction method in accordance with a second aspect of the present disclosure.

Reference is now made to FIG. 2 of the drawings, which illustrates a deep-water oil and gas exploration well 200. The well 200 shares many features with the well 100 described above and, in the interest of brevity, some of the common features will not be described again in any detail. Common features will be labelled with the same reference numerals, incremented by 100.

The apparatus and methods used in the initial construction of the well 200 are largely the same as those used in the construction of the well 100, however in the present well 200 the intention is to extend the bore 206 beyond the distal end of the cemented liner 220, but equally the method and apparatus described could be used for extending the bore 206 beyond the end of a cemented casing. Thus, after the liner 220 has been cemented and the inner string 240 uncoupled from the liner shoe 234 and retrieved to the drilling unit 202, a drilling assembly 270, in this example a 12¼" (31.1 cm) drilling assembly 270, is run into the well 200 and utilised to drill through the liner shoe 234 and create a 12¼" (31.1 cm) open hole 272 extending beyond the end of the liner 220.

The new open hole 272 will allow geophysical data to be obtained for the formations beyond the liner 220. The operator will then be better informed before drilling a larger diameter hole 274 (for example a 20" (50.8 cm) diameter bore) beyond the liner 220, using the 12¼" (31.1 cm) hole as a pilot bore.

When compared with conventional liner cementing operations, similar advantages to those described above with reference to the first well 100 are available. For example, a conventional liner cementing operation would have resulted in a cement plug extending the length of the shoe track, which would have to be drilled out before drilling the 12¼" (31.1 cm) hole 272. In deep water this would likely have added 1 to 1½ days to the well construction operation. Alternatively, if the 12¼" (31.1 cm) drilling assembly was used to drill through the shoe track cement plug an annulus of cement would have remained and there would be a significant risk that the remaining cement would cave in to the drilled bore and jam the drilling apparatus, preventing further drilling and possibly resulting in a stuck drill string.

Figure 3:
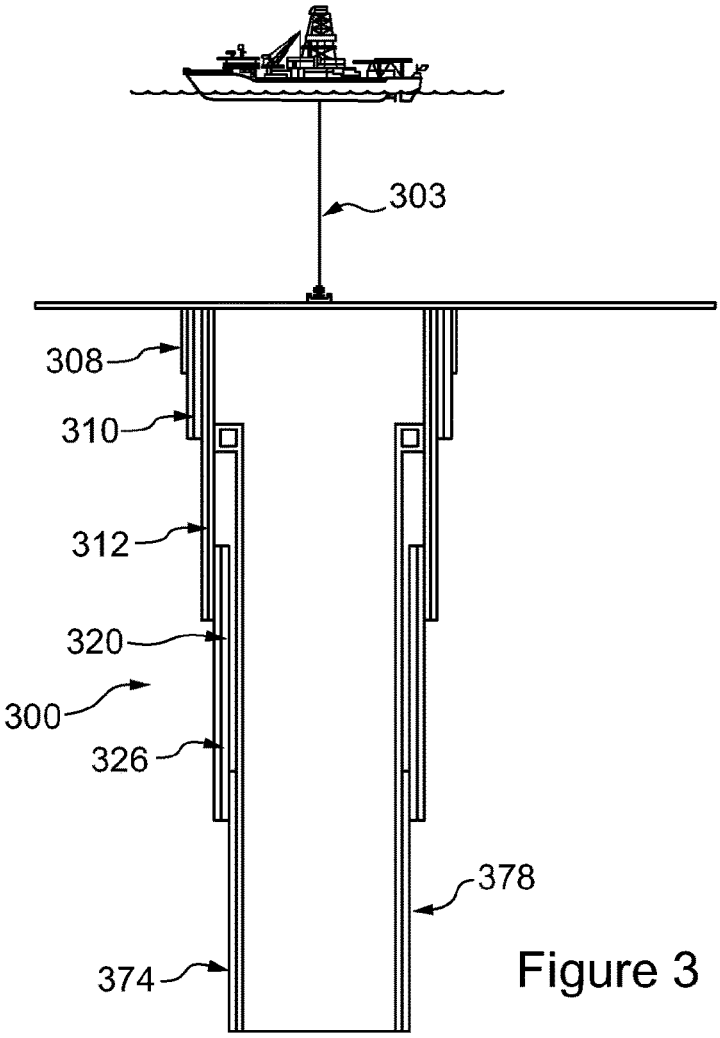
FIGS. 3 and 4 are schematics of a deep-water oil and gas well illustrating a well construction method in accordance with a third aspect of the present disclosure.
Figure 4:
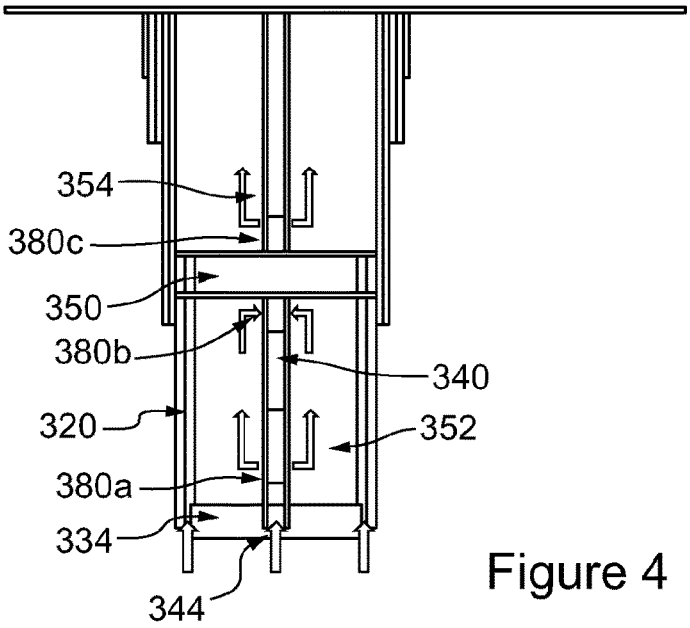

Reference is now made to FIGS. 3 and 4 of the drawings, which are schematics of a deep-water oil and gas well 300 illustrating a well construction method in accordance with a third aspect of the present disclosure. The well 300 shares many features with the well 100 described above, and common features are labelled with the same reference numerals, incremented by 200.

The well 300 includes similar structures to the well 100, including a 36" (91.4 cm) casing 308, a 28" (71.1 cm) conductor casing 310, a 22" (55.9 cm) surface casing 312 and an 18" (45.7 cm) liner 320. Additionally, the well 300 includes 16" (40.6 cm) liner 378 that has been cemented in a 20" (50.8 cm) open hole 374.

It will be observed that there are close tolerances between the bore-lining casings and liners. This will often be the case where multiple casings and liners are required to cover formations and zones that are, for example, weak, at high pressure, produce water, or even produce hydrocarbons. In the absence of such close tolerances, the final liner would have to be very small, restricting access and hydrocarbon production, or a very large diameter bore would be required, which takes significantly longer to drill with increased risks and requires significantly greater resources to construct.

An issue with close tolerance casing and liner is that the casings and liners must be run into the bore very slowly, to allow well fluid to be safely displaced from the volume below the casing or liner shoe. The displaced fluid travels up the annulus between the casing or liner and the adjacent casing or liner. Attempting to run the casing or liner into the bore too quickly can result in pressure surging which may, for example, damage the formation surrounding the open hole by forcing well fluid into the formation. Also, if a close tolerance casing or liner is pulled from the bore a swabbing effect (suction or negative pressure) may result, possibly drawing fluid from the surrounding formations or even collapsing the bore walls.

These affects are minimised or avoided by providing diverter tools or subs 380 in the inner string 340 and in the lower end of the liner running string 354. FIG. 4 illustrates the use of the diverter subs 380 when running in the 18" (45.7 cm) liner 320. In this example a lower sub 380*a* is provided directly above the liner shoe 334, an intermediate sub 380*b* is provided directly below the liner running tool 350, and an upper sub 380*c* is provided in the lower end of the liner running string 354. The diverter tools 380 include ports provided with valves which are open as the liner 320 is run into the well 300. This allows well fluid displaced from the bore section below the liner shoe 334 to flow through the open shoe port 344, into the lower end of the inner string 340, and then into the inner annulus 352. The shoe port 344 may be provided with a check valve that is initially held open to permit fluid to flow from the well 300 into the inner string 340. The fluid may then flow up through the inner annulus 352 and then flow back into the upper end of the inner string 340 through the intermediate sub 380*b*. The fluid may then flow through the liner running tool 350 and into the lower end of the liner running string 354, before passing through the upper sub 380*c* and into the bore volume above the liner running tool 350.

The open ports in the diverter subs 380 also allows pressure to equalise in the inner annulus 352 as the liner running assembly travels through the well 300.

The ability of the fluid in the riser 303 and the well 300 to flow into the liner running assembly as the assembly is made up and then run into the well 300 avoids the need to top fill the liner 320, inner string 340 and running string 354. Further, the ability of the liner assembly to self-fill minimises the volume of fluid that is displaced out of the well 300 (from the upper end of the riser 303) as the liner 320 is run into and through the well 300.

As noted above, running a conventional close tolerance casing or liner into a bore requires that the casing or liner is run into the bore relatively slowly, to allow the fluid in the bore to be displaced safely up through the narrow annulus between the casing or liner and the surrounding bore wall. However, the arrangement described above provides an additional flow path for the displaced fluid, via the inner string 340 and the inner annulus 352. This allows the operator to run the liner into the well 300 relatively quickly and minimises the risk of damage to the bore wall and the surrounding rock formation.

Once the liner 320 has reached target depth, the valves in the subs 380 are closed. For example, RFID tags may be pumped down through the liner running string 354 and the inner string 340, the tags being detected by sensors which then activate the battery-powered valves to close the ports provided in subs 380. As noted above, the shoe flow port 344 may be provided with a check valve that is initially held open to allow flow into the inner string 340. However, once the liner 320 has reached target depth the valve may be activated, to prevent further flow of bore fluid from the annulus 324 into the inner string 340.

As noted above in relation to the other aspects, the various valves provided may be activated by any suitable mechanism or method, for example the valves in the subs 380, or the valve in the port 344, may be operated by predetermined pressure pulses or flow sequences.

Cement 326 may then be circulated to fill the outer annulus 324 as described above with reference to the well 100.

In other examples, the ports provided in the diverter subs 380, particularly the ports provided in the lower sub 380*a* and the intermediate sub 380*b*, may be provided without valves and remain open. When cement is circulated the pressure in the inner annulus 352 may increase, but cement will not tend to flow into the annulus 352 via the open subs 380*a* and 380*b*.

It will be apparent to the skilled person that many of the elements of the various well constructions described above may be modified or omitted. For example, the skilled person would recognise that the number and dimensions of the various casing and liner sections may differ in other wells, for example some wells may be initiated with a 30" (76.2 cm) casing, and in some jurisdictions the operator will tend to use bore-lining tubing which is specified in metric units, rather than inches.

Further, the drawings illustrate methods being utilised in deep-water applications. The skilled person will recognise that the methods and apparatus described may also be utilised in shallower water, and indeed in land wells.

REFERENCE NUMERALS deep water well 100
wellhead 101
mobile offshore drilling unit 102
riser 103
sea surface 104
bore 106
casing sections 108, 110 and 112
seabed 113
casing section annuli 114
cement 116
liner 120
liner hanger 122
outer annulus 124
outer annulus cement 126
outer annulus cement slurry 126*a*
hydrocarbon-bearing formation 130
problem formation 132
liner shoe 134
inner string 140
upper string portion 140*a*
lower string portion 140*b*
end connector 142
shoe flow passage/port 144
valved port 146
telescopic section 148
liner running tool 150
inner annulus 152
liner running string 154
liner hanger slips 158
liner hanger seals 160 displacement fluid 164
top plug/ball 166
liner running tool valve 172
deep water exploration well 200
wellhead 201
mobile offshore drilling unit 202
riser 203
bore 206
liner 220
liner shoe 234
inner string 240
drilling assembly 270
12¼" open hole 272
20" hole 274
deep water well 300
wellhead 301
riser 303
36" casing 308
28" conductor casing 310
22" surface casing 312
18" liner 320
outer annulus 324
cement 326
liner shoe 334
inner string 340
shoe flow port 344
liner running tool 350
inner annulus 352
liner running string 354
20" open hole 374
16" liner 378
lower diverter sub 380*a*
intermediate diverter sub 380*b*
upper diverter sub 380*c*

The invention claimed is:

1. A well construction method in which a drilled bore is lined with a plurality of successively smaller diameter sections of bore-lining tubing, the well construction method comprising:

providing a bore-lining tubing with a shoe at a distal end thereof;

providing an inner string with a running tool mounted thereon;

coupling a distal end of the inner string to the shoe;

coupling the running tool to a proximal end of the bore-lining tubing;

running the bore-lining tubing, the inner string and the running tool into a fluid-filled drilled bore and displacing the bore fluid from a volume of the bore below the shoe up through the inner string;

pumping a settable material from surface, through the inner string, and through the shoe to at least partially fill an outer annulus surrounding the bore-lining tubing;

disengaging the running tool from the proximal end of the bore-lining tubing;

disengaging the distal end of the inner string from the shoe, and retrieving the inner string and the running tool from the bore-lining tubing.

2. The method of claim 1, wherein the bore-lining tubing is a liner.

3. The method of claim 1, further comprising at least one of:

(a) directing the displaced fluid between the inner string and an inner annulus between the inner string and the bore-lining tubing; and (b) directing the displaced fluid from the distal end of the inner string into a distal end of the inner annulus, and from a proximal end of the inner annulus into a proximal end of the inner string.

4. The method of claim 1, further comprising at least one of:

(a) directing displaced fluid from the inner string into a portion of the bore above the running tool; and (b) coupling at least one of the inner string and the running tool to a running string, the running string supporting the bore-lining tubing as the tubing is run into the bore, and displacing fluid from the bore volume below the shoe, through the inner string and into the running string, and then from the running string into a volume surrounding the running string.

5. The method of claim 1, further comprising:

drilling a final section of the bore to intersect a hydrocarbon-bearing formation; and running the bore-lining tubing into the final section of the bore such that the tubing extends into the hydrocarbon-bearing formation.

6. The method of claim 5, wherein the hydrocarbon-bearing formation is located above and in close proximity to at least one of: a formation containing high-pressure fluid; and a porous, low pressure formation.

7. The method of claim 5, further comprising reconfiguring at least a portion of the bore-lining tubing extending into or through the hydrocarbon-bearing formation to permit fluid to flow from the hydrocarbon-bearing formation into the tubing.

8. The method of claim 1, wherein the bore has been drilled in a seabed and a riser extends from the seabed to a rig floating on a sea surface, and the method further comprises running the bore-lining tubing into the bore through the riser.

9. The method of claim 1, further comprising:

filling an inner annulus between the bore-lining tubing and the inner string with fluid; and at least one of:

(a) allowing fluid to flow between an inner string bore and the inner annulus via a port provided in the inner string to equalise pressure between the inner string bore and the inner annulus as the bore-lining tubing is run into the bore; and (b) allowing the fluid to flow between the drilled bore and the inner annulus via the inner string and a port provided in the inner string.

10. The method of claim 1, further comprising:

providing a port in the distal end of the inner string and circulating fluid through the inner string to flush residual settable material from the inner string.

11. The method of claim 1, further comprising:

opening a port in the distal end of the inner string and circulating fluid through the inner string, and controlling the temperature of the fluid to influence the setting of the settable material in the outer annulus.

12. The method of claim 1, further comprising:

retaining a volume of the settable material in the distal end of the inner string and retrieving the volume of settable material from the bore for subsequent analysis.

13. The method of claim 1, further comprising:

filling an inner annulus between the bore-lining tubing and the inner string with fluid; and prior to running the bore-lining tubing to a final setting depth, hydraulically pressure-testing the bore-lining tubing by pressurising the fluid in the inner annulus.

14. The method of claim 1, further comprising providing a check valve in the shoe and maintaining the check valve open as the bore-lining tubing is run into the bore, and then reconfiguring the check valve to prevent the settable material from flowing from the outer annulus into the inner string.

15. The method of claim 1, further comprising:

running a pilot drill bit of a first cutting diameter into the bore and through the bore-lining tubing;

drilling beyond the distal end of the bore-lining tubing with the pilot drill bit to form a pilot bore;

retrieving the pilot drill bit;

running a larger drill bit of a second cutting diameter larger than the first cutting diameter into the bore; and enlarging the pilot bore with the larger drill bit.

16. A well construction method in which a drilled bore is lined with a plurality of successively smaller diameter sections of bore-lining tubing including a casing and a liner, the well construction method comprising:

drilling a final section of the bore beyond a distal end of an existing bore-lining tubing to intersect a hydrocarbon-bearing formation;

providing the liner, a liner hanger at a proximal end of the liner, a shoe at a distal end of the liner, a running tool coupled to the proximal end of the liner, and an inner string coupled to and extending between the shoe and the running tool;

running the liner into the final section of the bore such that the proximal end of the liner overlaps the distal end of the existing bore-lining tubing, and the liner extends into the hydrocarbon-bearing formation;

pumping a settable material from surface, through the inner string, and through the shoe to at least partially fill an outer annulus surrounding the liner;

setting the liner hanger to seal the proximal end of the liner to the distal end of the existing bore-lining tubing;

disengaging the running tool from the proximal end of the liner;

disengaging a distal end of the inner string from the shoe, and retrieving the inner string and the running tool from the liner.

17. The method of claim 16, wherein the hydrocarbon-bearing formation is located above and in close proximity to one of: a formation containing high-pressure fluid: and a porous, low pressure formation.

18. Well construction apparatus comprising:

bore-lining tubing;

a shoe at a distal end of the bore-lining tubing, the shoe including a flow port;

a running tool at a proximal end of the bore-lining tubing;

an inner string extending between the shoe and the running tool, the inner string being in fluid communication with an exterior of the bore-lining tubing via the flow port in the shoe and whereby an inner annulus is provided between the bore-lining tubing and the inner string; and a first port in the inner string allowing fluid to flow between the exterior of the bore-lining tubing and the inner annulus via the inner string; and a second port in the inner string for allowing fluid to flow from a proximal end of the inner annulus into a proximal end of the inner string.

19. The apparatus of claim 18, comprising a running string coupled to at least one of the inner string and the running tool, the running string including a port for allowing fluid to flow from an interior of the running string to an exterior of the running string.

* * * * *